United States Patent [19]

Spangler

[11] 4,048,691

[45] Sept. 20, 1977

[54] TRASH SACK SUPPORT

[76] Inventor: Glen C. Spangler, 13645 Reeveston Road, Houston, Tex. 77039

[21] Appl. No.: 675,850

[22] Filed: Apr. 12, 1976

[51] Int. Cl.[2] ..... A47L 13/52; A47F 13/06

[52] U.S. Cl. ..... 15/257.1; 294/55

[58] Field of Search ..... 15/257.1, 257.5, 257.9; 294/19 R, 55; 150/1

[56] References Cited

U.S. PATENT DOCUMENTS

| | | | |
|---|---|---|---|
| 3,733,099 | 5/1973 | Szitg | 294/55 |
| 3,747,653 | 7/1973 | Ringer | 15/257.1 |
| 3,754,785 | 8/1973 | Anderson | 294/55 |
| 3,942,832 | 3/1976 | Haas | 294/55 |

*Primary Examiner*—Edward J. McCarthy
*Attorney, Agent, or Firm*—G. Turner Moller

[57] ABSTRACT

A generally triangular shaped frame receives the open end of a sack with the end of the sack being overlapped on the frame. A handle is releasably engaged with the frame and includes means along the handle for engaging the overlapped sack end to aid in retaining the sack in open position on the triangular frame.

9 Claims, 6 Drawing Figures

TRASH SACK SUPPORT

SUMMARY OF THE INVENTION

Various arrangements have been provided for positioning a sack to enable articles such as trash, debris or other objects to be moved into the sack; however, so far as known to applicant, no arrangement is available to enable an open sack to be held by one hand while trash is pushed, pulled or otherwise moved into the open end of such sack by the other hand.

Accordingly, an object of the present invention is to provide a support to hold a sack in open position adjacent a surface so that trash on a surface may be pushed or pulled into the open end of the sack until the sack is full.

Yet a further object of the present invention is to provide a generally triangular shaped frame with which the open end of a sack may be engaged a handle engaged with the frame so that one side of the frame can be positioned on a surface to enable trash on a surface to be pushed into the open end of the sack and means adjustably carried on the handle for engaging the sack to retain it in open position on the frame.

Yet a further object of the present invention is to provide a generally triangular shaped frame with which the open end of a sack may be engaged, a handle engaged with the frame so that one side of the frame can be positioned on a surface to enable trash on a surface to be pushed into the open end of the sack, means carried on the handle for engaging and retaining the sack in open position on the frame, said means including an annular member slidably positioned on the handle, a projection extending from the member, an enlargment carried on the projection with which the sack may be engaged to aid in retaining the sack in open position on the frame and means for releasably retaining the annular member at selected positions longitudinally of the handle.

Yet a further object of the present invention is to provide a generally triangular shaped frame with which the open end of the sack may be engaged and wherein the frame is formed of strip material having ends for telescopically engaging with a handle to enable the frame to be positioned adjacent a surface for scooping trash into the open end of the sack, and said handle including means for engaging the ends of the frame to releasably secure the handle and frame together.

Other objects and advantages of the present invention will become apparent from a consideration of the following description and drawings.

DESCRIPTION OF THE PREFERRED EMBODIMENT

Figure 1:
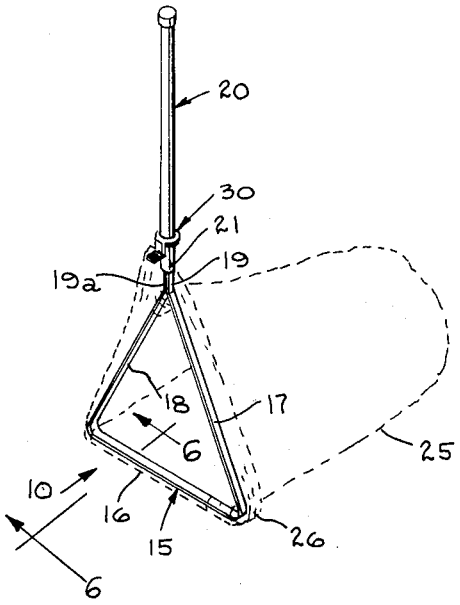
FIG. 1 is an elevational view showing the present invention with a bag in dotted line on the frame.

Attention is first directed to FIG. 1 of the drawings wherein the present invention is referred to generally by the numeral 10 and is shown as including a triangular frame 15 with handle means referred to generally at 20 secured thereto. A sack or bag is referred to in dotted line at 25 and is shown as being engaged with the frame 15 by means of the edge 26 adjacent the open end of the bag 25 overlapping the frame 15. Means 30 are provided on the handle 20 which may be adjusted relative to the handle 20 for engaging the overlapped edge 26 of the bag 25 to assist in retaining the bag in open position on the frame 15 as illustrated in FIG. 1 of the drawings.

The triangular shaped frame 15 in its preferred embodiment is generally in the shape of an equilateral triangle having a base 16 and sides 17 and 18. Also preferably the triangular shaped frame 15 is formed of a single strip of material, the ends 19 and 19*a* of which extend generally parallel from the apex of the triangular frame 15 and are adapted to be telescopically received within the lower end 21 of the handle 20. To provide additional strength to the frame, the strip of material may be curved laterally, or across its width, throughout the longitudinal extent of such strip of material.

The handle 20 may be of any suitable tubular material with the lower open end 21 being adapted to telescopically receive the parallel extending ends 19 and 19*a* of the triangular frame 15 as previously described. As more clearly shown in FIG. 2, the lower open end 21 of the handle 20 may be provided with a configuration represented generally at 22 in FIGS. 2 and 3 which provides slots 23 and 24 for receiving and releasably retaining the curved strip ends 19 and 19*a* telescopically within the lower open end 21 of the handle 20.

Figure 2:
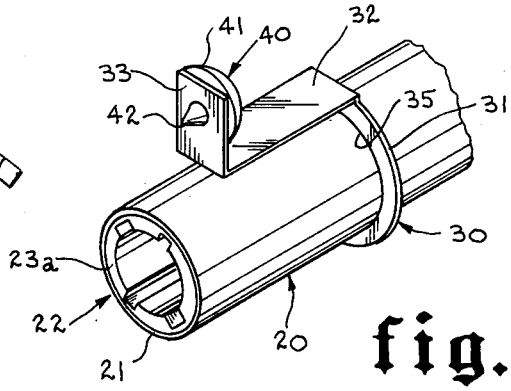
FIG. 2 is an enlargement of one end of the handle with means for engaging with the sack to retain it in position on the frame.

The means 30 adjustably carried on the handle 20 is shown in FIG. 2. in one form and includes an annular member 31 slidably positioned on the handle 20 and having a projection 32 integrally formed with the annular member 31 and extending therefrom. In the form of the annular member 31 as shown in FIG. 2 of the drawings, the projection 32 extends perpendicularly to the annular member 31 and longitudinally relative to the handle 20. The projection 32 includes an additional portion 33 formed generally at a right angle to the longitudinally extending portion 32, with the portion 33 having an enlargement 40 thereon. The enlargement 40 may be formed of any suitable material such as an elastomer 41 and may be positioned on the portion 33 by any suitable means such as the projection 42 which is forced through an opening in the portion 33 to frictionally secure the enlargement 40 in position on the portion 33. The details of the relationship between the projection 42 and opening 34 are shown in FIG. 4 and described hereinafter.

In the FIG. 2 form of the annular member 30, and by reason of the arrangement and relationship of the projection 32, the present invention may be employed to retain bags of smaller diameter in position on the frame 15 than might otherwise be possible. This is accomplished by reason of the fact that the projection 32 extends longitudinally from the annular member 30 towards the triangular shaped frame 15 as shown in FIG. 1 of the drawings so that if a bag smaller than that shown in FIG. 1 is to be positioned on the frame, the annular member 31 may be moved longitudinally of the handle and engaged with the end or edge 26 of such smaller bag which overlaps the frame members 16, 17 and 18 and then moved upwardly so as to retain the edge 26 in taut relationship relative to the frame members with which it is overlapped. It can also be appreciated that the opening 35 in the annular 30 may be of slightly larger diameter than the diameter of the handle 20 to enable the member 31 to be positioned longitudinally of the handle by sliding it therealong and after the bag has been positioned over the enlargement 40 and the annular member 31 then moved in a direction along the handle to firmly tension the overlapped portion 26 of the bag 25, the member 31 will tend to tilt relative to the longitudinal axis of the handle so as to frictionally engage therewith.

Figure 3:
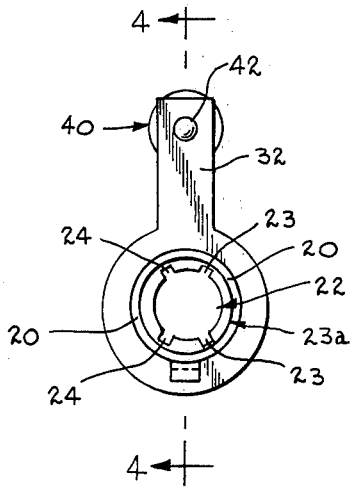
FIG. 3 is an end view of the handle illustrating an alternate arrangement of the means for securing the sack in position on the frame.
Figure 4:
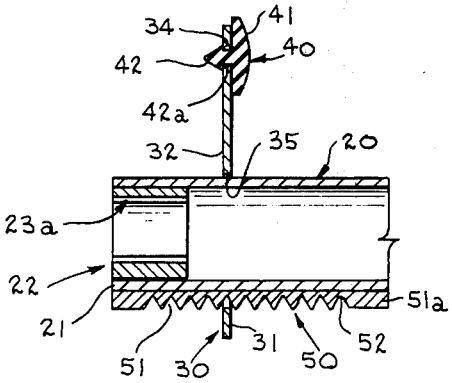
FIG. 4 is a sectional view on the line 4—4 of FIG. 3 illustrating further details of the present invention.

In FIGS. 3 and 4, means for releasably retaining the annular member 31 in position at a plurality of longitudinally selected positions along the handle is illustrated. The adjustable means 30 again includes the annular member referred to by the numeral 31 and is provided with an opening 35 to enable the device to be moved longitudinally of the handle. In this form of the invention the projection 32 extends radially from the annular member 31 as shown in the drawings. As in the FIG. 2 form, the enlargement 40 is an elastomer represented at 41 with a projection 42 extending through and fitting in an opening 34, formed in projection 32. The projection 42 on elastomer enlargement 40 is provided with an annular groove **42*a* to engage in opening 34 to retain the enlargement 40 in position on the radially extending projection 32** as shown in the drawings.

The arrangement 22 in the open end 21 of the handle 20 is shown in greater detail in FIG. 4 as including a tubular member **23*a* positioned adjacent the open end 21 of handle 20. The member 23*a* is provided with the longitudinal grooves 23, 24 therein as shown in FIGS. 2, 3 and 4 of the drawings. The ends 19, 19*a* of the frame 15 are inserted in the grooves 23, 24 and the handle 20 and frame 15** are thus releasably secured together.

In the form of the invention illustrated in FIGS. 3 and 4 of the drawings, the handle means 20 is provided with the means referred to generally at 50 for releasably retaining the annular member 31 at selected positions longitudinally of the handle means 20. Such means includes a plurality of serrations 51 in member **51*a* extending longitudinally of the handle 20 so that when the annular member 31 is positioned in a groove 52 between two of the serrations 51 after it has been engaged with the overlapping edge 26 of a bag and then moved longitudinally of handle 20 to place the bag edge 26 in tension as described with regard to FIG. 1, there is less likelihood of the means 30** to become dislodged relative to such handle.

From the foregoing description, it can be appreciated that in the use of the present invention, a bag 25 is positioned on the triangular frame 15 and the edge 26 overlapped on the frame members 16, 17 and 18 and engaged over the projection 40 of the means 30. The means 30 is then moved upwardly along the handle to tighten the edge 26 around frame 15 and to hold the overlapped edge portion 26 in a taut relationship to thus retain the bag 25 in open position on the triangular frame 15 during use.

With the bag in this position, it can be appreciated that the handle 20 can be grasped by an individual and trash adjacent the open end of the bag then pushed, pulled, or otherwise moved along the adjacent surface into the bag 25 by any suitable means.

In addition, it is to be noted that the frame portion 16 is flat so that it may be rested on or adjacent a surface, such as the ground or any other suitable surface, to enable trash, leaves and the like to be raked, moved or swept into the opened bag 25. Also, as shown the triangular shaped frame 15 is preferably in the form of an equilateral triangle to provide a maximum size opening.

Figure 5:
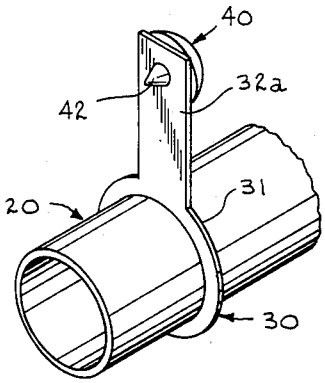
FIG. 5 is a partial view of another arrangement for engaging with a container.
Figure 6:
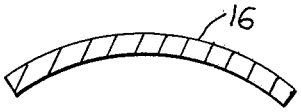
FIG. 6 is an enlarged cross-sectional view on the line 6—6 of FIG. 1 illustrating further details of the present invention.

In FIG. 5, the means 30 includes the annular member 31 for slidably fitting on handle 20 with projection **32*a*** extending laterally therefrom.

The enlargement 40 in the form of elastomer 41 is positioned adjacent the end of projection **32*a* by means of the projection 32*a* by means of the projection 42 as described with regard to FIG. 2**.

It can be appreciated that the shape or configuration of the elastomer surface 41 is not critical, and the end of projection **32*a*, as well as the end of projection 32 in the FIGS. 2–4 form could be coated with an elastomer by any suitable means such as dipping to provide a friction surface for engaging with sack or bag 25 to retain it in position on frame 15**.

It can also be appreciated that the present invention may be used indoors as well as outdoors to collect debris.

The present invention is quite adaptable for use with plastic garbage bags presently employed and can be used, by way of example only, for cleaning up leaves or trash in a yard. Whereas heretofore it has been necessary for one person to hold open a bag while trash or leaves are inserted thereinto, the present invention enables one person to manipulate the bag in position on a surface while employing the other hand to sweep or rake trash into the opened end of the bag 25 until it is full whereupon the means 30 may be moved to a position on the handle to release the overlapped edge portion 26 from the frame 15 for closing of the bag.

The foregoing disclosure and description of the invention are illustrative and explanatory thereof, and various changes in the size, shape, and materials as well as in the details of the illustrated construction may be made without departing from the spirit of the invention.

What is claimed is:

1. An arrangement for supporting a sack to receive articles comprising:

a. generally triangular shaped frame means with which the open end of a sack may be overlapped;

b. handle means engaged with said frame means so that one side of said frame means can be positioned on a surface to enable articles on the surface to be moved into the opened end of the sack; and c. means adjustably carried on said handle means for engaging the overlapped sack end to retain the sack in position on said frame means, said means adjustably carried on said handle including

1. a member slideably positioned on said handle means;

2. projection means extending from said member including a segment extending longitudinally of said handle means; and

3. a friction surface means on said projection means with which the overlapped sack end may be engaged to aid in retaining the sack in open position on said frame means.

2. The invention of claim 1 including means for releasably retaining said member at selected positions longitudinally of said handle.

3. The invention of claim 2 wherein said means for releasably retaining said member includes serrations arranged longitudinally on said handle means.

4. The invention of claim 1 wherein said projection means includes a segment extending generally radially from said member.

5. The invention of claim 1 wherein:

a. said frame means is formed of a strip material having ends for telescoping in said handle means; and b. said handle means includes means for engaging said ends to releasably secure said handle and frame means together.

6. The invention of claim 1 wherein:

a. said frame means is formed of a strip material having ends for telescoping in said handle means; and b. said handle means includes means for engaging said ends to releasably secure said handle and frame means together.

7. The invention of claim 1 wherein:

a. said frame means is formed of a strip material having ends for telescoping in said handle means; and b. said strip material is curved across its width to provide strength to said frame.

8. The invention of claim 1 wherein said friction means comprises an elastomer surface means on said projection means to frictionally engage the sack on said frame means.

9. The invention of claim 8 wherein said elastomer surface means includes an elastomer enlargement.

* * * * *